US005121547A

United States Patent [19]

Littlejohn

[11] Patent Number: 5,121,547

[45] Date of Patent: Jun. 16, 1992

[54] PENDULUM BOW SIGHT WITH TELESCOPIC SCOPE

[76] Inventor: Bert K. Littlejohn, 457 Fisher Ct., Clawson, Mich. 48017

[21] Appl. No.: 733,436

[22] Filed: Jul. 22, 1991

[51] Int. Cl.[5] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 3,266,149 | 8/1966 | Powell | 33/265 |
| 4,368,581 | 1/1983 | Tullos | 33/265 |
| 4,616,422 | 10/1986 | Gaddy | 33/265 |

OTHER PUBLICATIONS

A bow hunting supply catalog by, Discount Warehouse, Inc., Spring Edition 1991, pp. 80, 81, 87, 91 and 92.

*Primary Examiner*—Harry N. Haroian

*Attorney, Agent, or Firm*—Brooks & Kushman

[57] ABSTRACT

A bow sight to aid an archer when shooting from an elevated platform—such as a tree stand. This particular type of bow sight works on the pendulum principle. All pendulum sights work basically on the same principle. That is, once the unit is sighted-in using the pin designated by the manufacturer, that pin can then be held on target from the base of the tree to thirty-five yards distance. The unique design of this particular pendulum sight enables the incorporation of a scope for magnification of target. This sight also incorporates a locking device which enables the archer to use the unit as a conventional sight for ground level shooting.

11 Claims, 1 Drawing Sheet

PENDULUM BOW SIGHT WITH TELESCOPIC SCOPE

FIELD OF THE INVENTION

This invention relates to pendulum bow sights and bow sights having telescopic lenses.

I have done most of my hunting from tree stands in the last few years. Last year I decided I would go to one of the pendulum sights on the market. Also, I had been looking at different scopes available for bows. I finally reasoned that I wanted to find a pendulum sight in which I could incorporate a scope. Unfortunately, I could not find a penulum sight on the market with those capabilities, so I resolved to build one myself.

Making three separate trips to the library to do patent searches, I could not find anything similar to what I had made. Although I found many different kinds of pendulum sights, I could not find any that incorporated a scope, or with the capabilities of incorporating a scope. Since I could find nothing similar in design to what I have constructed, I thought it would be useless to list all of the pendulum sights and bow scopes which have been patented.

SUMMARY OF THE INVENTION

The main objective of this bow sight is to enable an archer to shoot at a target from an elevated platform, such as a tree stand, and use only one point-of-aim. That is, no matter how close the target comes to the tree, or how far away it moves (up to thirty-five yards), only the one point-of-aim has to be used to hit dead-on target. Also, this bow sight incorporates a large two power scope so that the target in question can be seen twice as large as with the naked eye. Therefore making point-of-aim a set of crosshairs in the middle of the scope. This bow sight also has the ability to be used as a conventional stationary sight for shooting on a ground level situation.

The bow sight consists of two aluminum bearing plates with three aluminum gears sandwiched in between. A long bolt is installed through the bearing plates and the top gear. This bolt is used to attach the base unit to the mounting plate. A precisely machined pin is installed through the bearing plates and the middle gear. The pin has a slotted head on one end, and is threaded about one eighth of an inch on the other end, so as to accomodate a small nut. The third gear is held in place by the bolt which is used to attach the scope to the base unit. The entire bottom half of the base unit is machined from a solid block of steel. This is the weight that is necessary for the pendulum action. The steel weight is attached to the bearing plates with two slotted-head screws and nuts. In the center of the bottom of the weight is a hole. This hole is drilled and tapped to accomodate the thumbscrew used for the lock-down feature.

The top of the base unit would be covered to protect the gears. Any hard lightweight material would do, aluminum, graphite, etc. I took the largest scope I could find (three inch) and modified it so it could be used with this unit. Although, I think the ideal size scope would be about two and one half inches, (I couldn't find one of that size on the market). Smaller scopes have a one stem mounting system. A scope of this size (three inches) requires a two stem mount. I machined a piece of one-eighth inch plate steel to fit precisely on these two mounting stems. In the exact center of this plate I installed the bolt that would be used to attach the scope to the base unit. After bolting this new plate to the stems, all excess stem material was cut off. It is to be understood that there are many smaller bow scopes on the market. These scopes have a range of two to eight power magnification. Being the small diameter that they are, they all have a one stem mounting system. All of these smaller scopes are used basically for target competition shooting. The problem with using them for hunting game is this; let's say we took a one and one-quarter inch four power scope to hunt with, if the game animal was of any size, such as a deer, when the hunter goes to pick up the animal in the scope, all he would see is a small area of brown on the side of the deer (providing the animal is standing broadside to the hunter). In order to see the entire deer in a scope of that diameter and power, the deer would have to be so far away as to be out of bow range. Hence, the necessity of large diameter low power scopes for hunting.

The mounting plate that is used to attach the bow sight to a bow has a larger offset than any mounting plate I have seen. This offset is necessary to accomodate the pendulum mechanism. A sliding or adjustable L-bracket is attached to the bottom end of the mounting plate. The very bottom of this L-bracket has a hole to accomodate the thumbscrew which is used to lock the pendulum mechanism in a stationary position. On the outside edge of the L-bracket, near the bottom, there is a hole, drilled and tapped to store the thumscrew when the unit is in use as a pendulum sight. When this unit is used as a conventional stationary sight—three additional points-of-aim are on a graduated scale below the crosshairs.

I have also added to my unit a fiber-optic lighted sight pin. This being installed with the head of the pin in the center of the cross-hairs, giving a better aim point, especially in low light conditions, such as mornings, evenings and cloudy days. Although I think the pin should be offered as an option rather than standard equipment because; 1.) some people wouldn't want it anyway, and 2.) keeps costs lower.

DETAILED DESCRIPTION OF THE DRAWINGS

Figure 1:
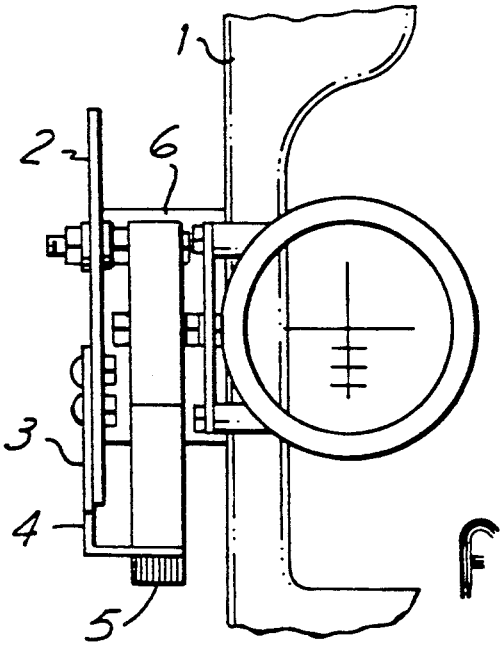
FIG. 1. Shows a standard model of the entire unit mounted on a cut-away version of a bow. The pendulum weight is in lock-down position with the thumbscrew screwed in the bottom.

In FIG. 1. we see the complete bow sight attached to a cut-away version of a bow. The bow being illustrated by the numeral 1. Numeral 2 indicates the mounting plate which is used to attach the sight to the bow. Numeral 3 indicates the lock-down L-bracket. This bracket is necessary for locking the pendulum in a stationary position. This feature would be necessary even if the sight were not used as a conventional stationary sight for ground-level shooting. When a bow is stored, traveling in a vehicle, or carried to and from a stand, the pendulum should be in the locked-down position. The pendulum pivotally attached to the mounting plate and remaining plumb when the bow is aimed at targets at various elevations,--; should be free-swinging only after the archer is in a position to shoot from an elevated platform. Also, the L-bracket should be adjusted to where the bottom of the pendulum clears the bracket by about one sixteenth of an inch. Numeral 4 indicates the threaded hole in which the thumbscrew is stored when the pendulum is free to swing. Here the latter is shown screwed into the bottom of the pendulum. This is the lock-down position. Numeral 6 indicates the offset portion of the mounting plate. Several views of the mounting plate was necessary to show the amount of offset needed.

Figure 2:
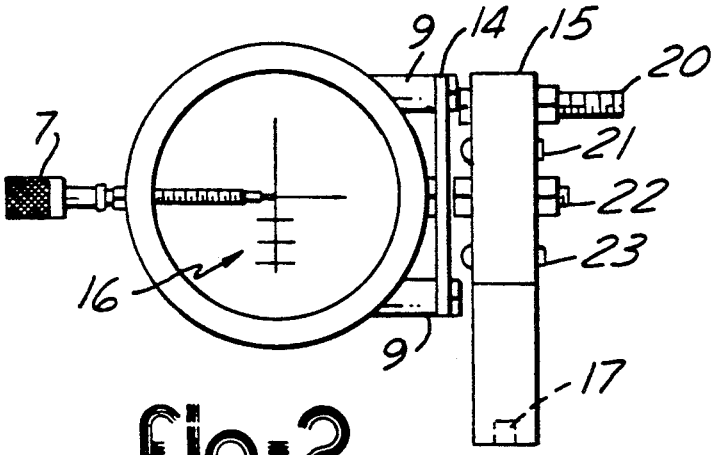
FIG. 2. Shows the bow sight from an archers view. This unit has the optional lighted sight pin installed. The unit is shown without the mounting plate attached—as it would tend to obliterate most of the working mechanism.

In FIG. 2. we see the complete bow sight (less the mounting plate) from an archer's perspective. Again, it was necessary to leave off the mounting plate (when viewing from this side) so as not to block the view of most of the working mechanism. Here numeral 7 indicates the fiber-optic lighted sight pin that would be available, (but optional). Numeral 16 indicates the three additional points-of-aim. In other words; if an archer is shooting ar ground level, and using the crosshairs in the scope, he hits dead-on-target at twenty yards. Then the first line below the crosshairs would make a hit right around twenty-five yards, and the next line below that should hit right about thirty yards, and the last line right about thirty-five yards. Of course, these lines were established by what the "average" bow should shoot. Some very fast shooting cam bows of today may increase those distances to seven or eight yards between each line. Numerals 9 indicate the two stems necessary to mount a scope of this size. Numeral 14 indicates the new steel plate that was made to convert from a two stem mount to a single stem mount. After the new plate was bolted to the old stems, all excess stem material was cut off. In the exact center of the plate, a bolt was installed. Numeral 22 indicates this bolt. This is the bolt by which the scope is mounted to the base unit so that the telescopic scope is pivotally mounted to the pendulum. This bolt also holds the third or lowest gear in place. Numeral 21 indicates the pin which holds the middle gear in place. Numeral 20 indicates the bolt that is used to mount the entire unit shown in FIG. 2 to the mounting plate. The extra length is necessary for windage adjustments. This bolt is also used to keep the first, or top gear in place.

Numeral 15 indicates the dust cover which protects and keeps foreign matter from getting into the gears. This dust cover would have to be watertight. If water were to get in the gears and freeze—the unit would become inoperable as a pendulum sight until the ice melted. Numeral 23 indicates the screws and nuts necessary for attaching the pendulum weight 13 to the bearing plates 11. Numeral 17 indicates the drilled and tapped hole in the bottom of the pendulum weight that accomodates the thumbscrew used for lock-down of said unit. This hole would be very shallow, and allow the thumbscrew to bottom quickly.

Figure 3:
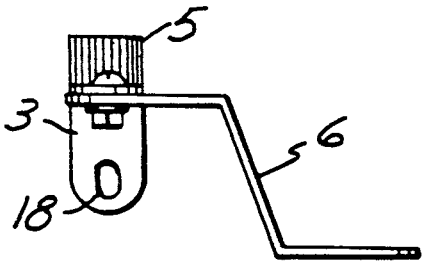
FIG. 3. Gives a top or bird's eye view of the mounting plate with the lock-down L-bracket attached. This view shows the large offset needed to accomodate the pendulum mechanism. It also shows the thumbscrew in the stored position.

In FIG. 3 we see a bird's eye or top view of the mounting plate 2 with the lock-down assembly 3 attached. The thumbscrew 5 is in its stored position. Numeral 6 again indicating the offset. From this view one can see the amount of offset necessary. Numeral 18 indicates the oval shaped hole in the bottom of the L-bracket 3 that is used for the insertion of the thumbscrew 5 into the bottom of pendulum weight 13.

Figure 4:
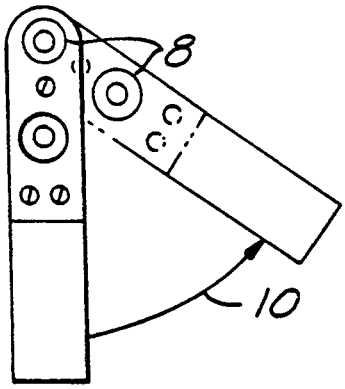
FIG. 4. Shows the base unit from a side view. This view shows the action of the pendulum.

In FIG. 4 we see a side view of the base unit. We have eliminated the mounting bolts 20 and 22 in this view so that we would have a clear view of the ball bearings indicated by numeral 8. There are two bearings like this in each of the two bearing plates 11. FIG. 4 shows the forward movement of the pendulum as indicated by the numeral 10. This action is what would be seen as the bow 1 is tilted forward. Such action raises the scope in direct ratio to the amount of tilt—keeping the crosshairs dead-on target as the animal moves in closer to the tree.

Figure 5:
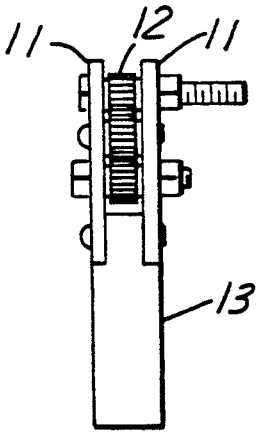
FIG. 5. Shows the base unit from an archer's view. The dust cover has been removed to show the three gears and bearing plates. This basic unit is the embodiment of the invention per se.

In FIG. 5 we see the base unit without the dust cover 15. By eliminating the dust cover we can see the gears as indicated by numeral 12. We may now imagine the action of the gears as the pendulum 13 swings forward. Actually, the top gear remains stationary, only the middle and lower gears turn as the pendulum swings forward, but only because they are in mesh with the top gear. The turning action of the lower gear—to which the scope mounting bolt 22 is attached, allows the face of the scope to always be in a direct line-of-sight with the eye of the archer. Therefore, the interaction of the gears provides means for automatically pivoting the telescopic scope relative to the pendulum in response to the pivoting of the pendulum relative to the mounting plate so that the telescopic scope remains aligned with the archer's line-of-sight. In other words, no matter how much the bow 1 is tilted forward, the archer will always be looking directly at the face of the scope. Also, without the dust-cover, from this position we have a better idea of what the bearing plates 11 look like. In FIG. 5 which I call the base unit, we have the embodiment of the invention. This unit, in and of itself, is the basis for this invention. Its operation, I believe, is unique, and worthy of a patent.

Figure 6:
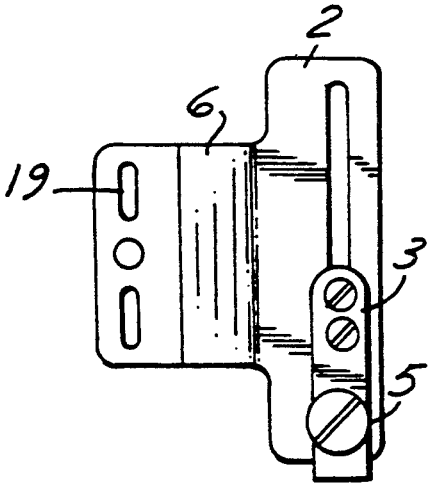
FIG. 6. Is a side view of the mounting plate with the lockdown L-bracket attached. This view shows the adjustability of the L-bracket. It also shows the thumbscrew in its stored position.

In FIG. 6 we see a side-view of the mounting plate 2. This view also shows the L-bracket 3 from a different angle. The thumbscrew 5 is shown in its stored position. Numeral 6, again, indicates the large offset. Numeral 19 indicates the slotted holes used for mounting the plate to the bow 1.

I claim:

1. A pendulum sight for an archer's bow, the sight comprising:

a mounting plate adapted to be affixed on the bow;

a pendulum pivotally attached to the mounting plate, the pendulum remaining plumb when the bow is aimed at targets at various elevations;

a telescopic scope pivotally mounted to the pendulum; and means for automatically pivoting the telescopic scope relative to the pendulum in response to the pivoting of the pendulum relative to the mounting plate so that the telescopic scope remains aligned with the archer's line-of-sight.

2. The invention of claim 1 wherein the means for automatically pivoting comprises first and second spaced apart rotary members and a connecting member mechanically interconnecting the rotary members causing the scope to pivot with the second rotary member relative to the first rotary member.

3. The invention of claim 2 wherein the first and second rotary members and the connecting member are gears.

4. The invention of claim 1 further including a locking mechanism to releasably lock the pendulum to the mounting plate to prevent pivotally movement therebetween.

5. The invention of claim 1 wherein the scope further includes a point-of-aim.

6. The invention of claim 5 wherein the point-of-aim is a cross-hair located on the scope.

7. The invention of claim 5 wherein the point-of-aim is a sight pin.

8. The invention of claim 7 wherein the sight pin is lighted sight pin.

9. A method of aiming an archer's bow, comprising the steps of:

providing a pendulum sight having a mounting plate, a pendulum and a telescopic scope;

affixing the mounting plate to the bow;

pivotally attaching the pendulum to the mounting plate so that the pendulum remains plumb when the bow is aimed at targets at various elevations;

pivotally mounting the telescopic scope to pendulum; and automatically pivoting the telescopic scope relative to the pendulum in response to the pivoting of the pendulum relative to the mounting plate so that the telescopic scope remains aligned with the archer's line-of-sight.

10. The invention of claim 9 wherein the automatic pivoting of the telescopic scope relative to the pendulum is accomplished by attaching a first rotary member relative to the pendulum, attaching a second rotary member relative to the telescopic scope, mechanically interconnecting the first and second rotary members with a third connecting member causing the telescopic scope to pivot with the second rotary member relative to the first rotary member.

11. The invention of claim 10 wherein the first and second rotary members and the connecting member are gears.

* * * * *